US005843531A

United States Patent [19]

Klett

[11] Patent Number: 5,843,531

[45] Date of Patent: Dec. 1, 1998

[54] CURTAIN COATER FOR FLUID BINDER APPLICATION

[75] Inventor: Paul A. Klett, Newark, Ohio

[73] Assignee: Owens Corning Fiberglas Technolgy, Inc., Summit, Ill.

[21] Appl. No.: 987,896

[22] Filed: Dec. 10, 1997

[51] Int. Cl.[6] ..... B05D 1/30

[52] U.S. Cl. ..... 427/420; 118/DIG. 4

[58] Field of Search ..... 427/420; 118/DIG. 4, 118/419, 324, 325

[56] References Cited

U.S. PATENT DOCUMENTS 4,427,722 1/1984 Keller .

*Primary Examiner*—Brenda A. Lamb

*Attorney, Agent, or Firm*—C. Michael Gegenheimer; Inger H. Eckert

[57] ABSTRACT

A binder applicator for applying binder to a moving substrate includes a distribution pipe extending transverse to the direction of movement of the substrate, with the distribution pipe having a bottom provided with a discharge opening. A distributor channel receives liquid binder from the discharge opening and directs the liquid binder upward. A horizontal reservoir receives the liquid binder material from the distributor channel, and a weir meters the discharge of the binder from the horizontal reservoir to form a thin horizontal flow of liquid binder material. A curved surface receives the thin flow of binder material and gradually changes the flow path to a substantially vertical thin flow of binder material for discharge onto the moving substrate.

18 Claims, 3 Drawing Sheets

CURTAIN COATER FOR FLUID BINDER APPLICATION

TECHNICAL FIELD AND INDUSTRIAL APPLICABILITY OF THE INVENTION

This invention relates to application of liquid binder material onto substrates, such as a nonwoven fibrous web material traveling on a conveyor past a binder application station. More particularly, the invention pertains to apparatus for presenting a very thin but uniform flow of liquid binder material for application onto a substrate to form a bindered fibrous nonwoven web. An example of a nonwoven web that can be made using the binder applicator of the invention is a wet process mat suitable for use as a shingle mat.

BACKGROUND OF THE INVENTION

Fibrous web material, both as a woven and as a nonwoven matrix, has many uses, but is particularly useful as a reinforcement for various products. Such webs are also useful for their absorptive properties. Fibrous web material can be made of mineral fibers, such as glass fibers, or of synthetic or organic fibers, such as polyester fibers or cellulose fibers. Typically, these fibrous webs are held together or bonded together by the application of an organic binder material. Examples of organic binders include urea formaldehyde binders, starch-based binders, and latex binders. One method of binder application is the use of a curtain coater that uses a dam or weir to form a thin waterfall or curtain of the liquid binder material, directed onto the fibrous web. The freefalling curtain of liquid extends transversely across the path of travel of the moving web. An example of such a curtain coater is U.S. Pat. No. 4,427,722 to Keller. After the application of the binder, the fibrous web is usually passed through an oven where the binder material is dried and cured.

In the interest of reducing manufacturing costs of fibrous web material, while still maintaining the desired strength and flexibility attributes for these webs, web manufactures have attempted to reduce the amount of binder material applied to the webs. To that end, the curtain of flowing liquid binder from a curtain coater is restricted to a thinner and thinner flow. Unfortunately, the thin flows of liquid binder material can be more easily interrupted by several different factors, including the presence of undissolved solids in the liquid binder material, and foam or air bubbles in the solution. Any interruption of the curtain of liquid material causes defects in the fibrous web product. U.S. Pat. No. 3,205,089 to Kinzelman discloses a liquid coater having a fluid channel forming a basin supplied with binder fluid by long pipe having binder outlet orifices. The liquid binder flows upward through the basin and laterally across the rather short surface of a weir. Then the liquid abruptly turns 90 degrees and flows downwardly along an inclined surface before dropping onto the fibrous web. To avoid turbulence in the surface of the liquid at the top of the basin, a diffuser separates the lower basin region from the upper basin region.

Despite these advances, there are still problems in delivering thin curtains of liquid while avoiding discontinuities in the application of the liquid material to the substrate. It would be advantageous if there could be developed a liquid curtain coater that provides an even more uniform flow of coating material than previously available.

SUMMARY OF THE INVENTION

The above objects as well as other objects not specifically enumerated are achieved by a binder applicator for applying binder to a moving substrate, where the binder applicator includes a distribution pipe extending transverse to the direction of movement of the substrate, with the distribution pipe having a bottom provided with a discharge opening. A distributor channel receives liquid binder from the discharge opening and directs the liquid binder upward. A horizontal reservoir receives the liquid binder material from the distributor channel, and a weir meters the discharge of the binder from the horizontal reservoir to form a thin horizontal flow of liquid binder material. A curved surface receives the thin flow of binder material and gradually changes the flow path to a substantially vertical thin flow of binder material for discharge onto the moving substrate.

In another embodiment of the invention, the binder applicator includes a distribution pipe extending transverse to the direction of movement of the substrate, with the distribution pipe having a bottom provided with a plurality of discharge orifices, and having a top. Further included is a distributor channel for receiving liquid binder from the discharge orifices and for directing the liquid binder upward, a horizontal reservoir for receiving the liquid binder material from the distributor channel, and a weir for metering the discharge of the binder from the horizontal reservoir to form a thin horizontal flow of liquid binder material. A curved surface receives the thin flow of binder material and gradually changes the flow path to a substantially vertical thin flow of binder material for discharge onto the moving substrate.

In another embodiment of the invention, a method of applying binder to a substrate includes moving the substrate along a machine direction, and discharging liquid binder from the bottom of a distribution pipe extending transverse to the direction of movement of the substrate. The liquid binder from the discharge orifice is received from the discharge orifice and is directed upward through a distributor channel. The liquid binder material is received from the distributor channel into a horizontal reservoir, and the discharge of the binder is metered from the horizontal reservoir with a weir to form a thin horizontal flow of liquid binder material. The flow path of the binder material is gradually changed with a curved surface from a thin horizontal flow to a substantially vertical thin flow of binder material, and the binder material is discharged onto the moving substrate.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

The description and drawings disclose a process for applying a liquid binder solution to a moving substrate consisting of glass fibers. It is to be understood that the substrate could also be made up of different mineral fibers, such as basalt fibers or ceramic fibers, as well as organic or synthetic fibers, such as polyester fibers, cellulose fibers or nylon fibers. Further, although the invention is described as being applicable for applying binder to a wet process mat, it is to be understood that the binder applicator can be used during the manufacture of other substrates, such as continuous strand mats. The invention is suitable for any water based binder.

Figure 1:
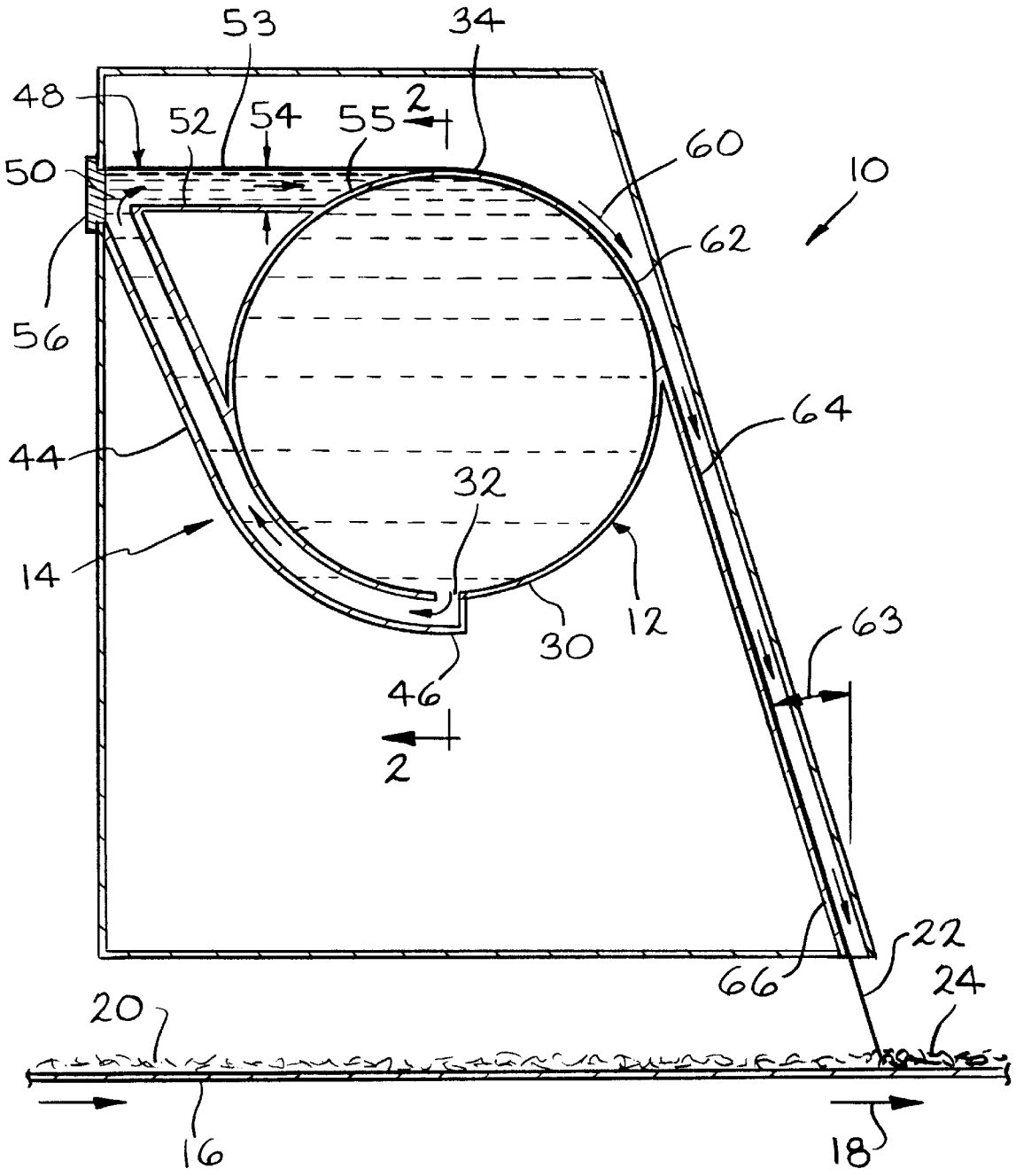
FIG. 1 is a schematic cross-sectional view in elevation of a liquid binder applicator of the invention.
Figure 2:
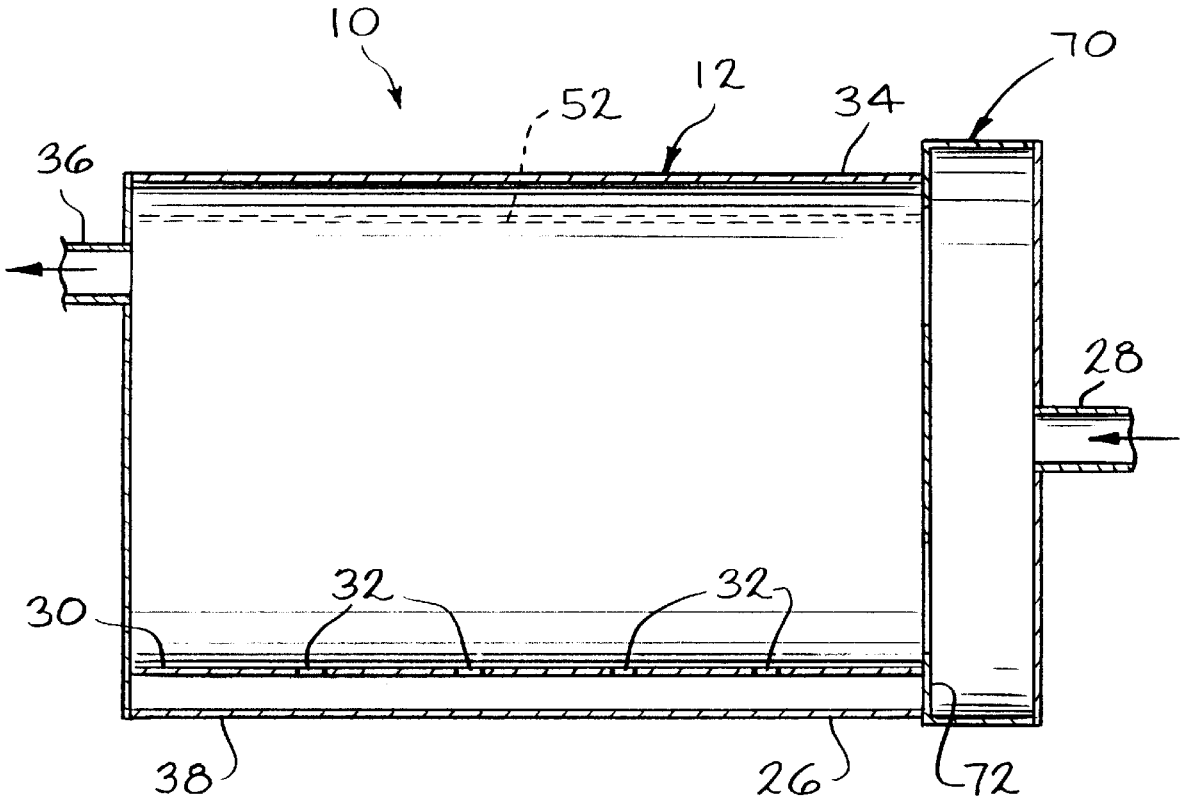
FIG. 2 is a schematic front view in elevation of the liquid binder applicator of FIG. 1.

As shown in FIGS. 1 and 2, the liquid binder applicator is indicated generally at 10. The applicator is comprised of a distribution pipe 12 and a distributor channel 14. The pipe extends transversely across a conveyor 16 traveling in a machine direction, indicated by arrow 18. Traveling on the conveyor 16 is a substrate in the form of a nonwoven web 20 of glass fibers. Typically, this web 16 contains about 50 percent water. The applicator deposits liquid binder material onto the nonwoven web 20 in the form of a uniform, stable liquid curtain 22 to form a bindered nonwoven web 24. The bindered nonwoven web 24 is then in condition to be taken through an oven, not shown, where the binder material is dried, and to form a completed nonwoven mat, not shown. Typically, the binder material is also cured while the mat is in the oven.

The pipe 12 is preferably of a large diameter, such as about 12 inches in diameter, to impart rigidity to the pipe and prevent sagging. The pipe is supported at both ends by means, not shown. Any suitable material, such as stainless steel, can be used for the pipe, and the pipe can have a circular cross-sectional shape as shown, or can have other shapes such as oval or rounded rectangle or square, not shown. Ideally, the structure of the pipe is sufficiently strong that any sag in the pipe is relatively small compared to the thickness of the liquid binder as it flows across the top 34 of the pipe. Typical wet process mat making machines are about 3 or 4 meters wide, and the pipe should be sized so that the ratio of the machine width to the pipe diameter is within the range of from about 10:1 to about 15:1. Another critical aspect in sizing the pipe is the time required for air bubbles to rise or float to the top of the pipe. The larger the pipe diameter, the slower the flow of the liquid binder material, and the greater the chance that the undesirable bubbles will be removed by floatation from the liquid. The dwell time required for the removal of the bubbles will also be a function of the viscosity of the liquid, which can vary anywhere from about 1 centipoise or lower to about 20 centipoise or higher.

The pipe 12 is supplied with liquid binder, from a source not shown, at a first or inlet end 26 of the pipe via an inlet conduit 28. The pipe 12 is provided along its bottom surface 30 with a discharge opening through which the liquid binder flows into the channel 14. As shown, the discharge opening can be a plurality of discharge orifices 32, but it is to be understood that other types of discharge opening, such as a single slot, not shown, could be used.

One of the features of the binder applicator of the invention is that the liquid binder flows from the bottom of the pipe rather than from the top of the pipe. This flow path maintains any foam or other entrained air at the top 34 of the pipe, where it can be drawn off via the foam exhaust conduit 36 at the distal or exhaust end 38 of the pipe. The removal of foam from the liquid binder is important because if any of the foam is dropped onto the nonwoven web 20, a product defect will be created. Further, foam could cause a curtain break in the curtain 22 of liquid binder, resulting in a no-binder spot on the nonwoven web, and a consequent product defect.

The purpose of the distributor channel 14 is to provide an even flow of the liquid binder along a path designed to minimize and eliminate turbulence. Another important aspect of the design of the distributor channel is to eliminate dead spots and regions of stagnant flow to reduce the buildup of binder solids within the distributor channel. The distributor channel is generally comprised of a binder receiving leg 44 and a sloping up leg 46. The up leg 46 leads to a horizontal reservoir 48. The distributor channel is preferably made of stainless steel, but can be made of other materials as well. The binder receiving leg 44 is adapted to receive the liquid binder material from the pipe orifices and direct the liquid binder along a curved path to begin a transition to a generally laminar, non-turbulent flow. A preferred width of the binder receiving leg is about 1½ inches, although the dimensions for any particular system will depend on such factors as the flow throughput required, the viscosity of the binder, the flow resistance of the material making up the distributor channel, and the operating pressure of the system.

The sloping up leg 46 directs the liquid binder upward, and preferably is roughly the same width as that of the receiving leg 44. The sloping up leg 46 helps the liquid binder become even less turbulent as the liquid flows upwardly.

The horizontal reservoir 48 is formed as the binder flows around corner 50 and onto a shelf 52. The flow of liquid binder along the shelf provides an even greater chance for turbulence in the liquid to decay. The shelf 52 should be easy to clean. The top surface 53 of the liquid binder in the horizontal reservoir 48 should be a disturbance-free liquid surface. A surface at the top 34 of the pipe 12 acts as a dam or weir for the liquid binder in the horizontal reservoir 48 of the distributor channel 14, thereby for metering the discharge of the binder and forming a thin flow of liquid binder material having a uniform depth extending all the way across the applicator 10.

The depth of the horizontal reservoir is defined by the distance 54 between the height of the shelf 52 and the height of the top 34 of the pipe. The depth 54 of the horizontal reservoir 48 must be deep enough to prevent significant currents within the liquid binder. A preferred depth 54 is about 1½ inches, although the optimum depth for such an apparatus will vary as a function of such factors as the flow throughput required, the viscosity of the binder, the flow resistance of the material making up the horizontal reservoir channel, and the velocity of the liquid in the horizontal reservoir. The critical aspect of the operation of the horizontal reservoir is the requirement for a smooth surface. Ideally, any surface imperfections in the liquid binder, as the liquid approaches the point where it is drawn off from the horizontal reservoir as a thin flow, are small in comparison with the height or thickness of the flow of binder leaving the horizontal reservoir.

The horizontal reservoir is preferably provided with a sloped outlet surface 55, that can be either curved or linearly sloped. This sloped surface 55 enables the liquid binder to be drawn off with a minimum of disturbance of the laminar flow. The sloped surface can follow the contour of the pipe, as shown, or it can have a different contour. As a matter of convenience, the distributor channel 14 can be provided with removable parts, such as cleanout panel 56, to enable the distributor channel to be cleaned out.

As the binder material flows from the pipe 12, through the binder receiving leg 44, up the sloping up leg 46, and into the horizontal reservoir 48, the amount of throughput flowing into the applicator 10 will determine the throughput of binder flowing out from the applicator. A typical throughput is within the range of from about 5 to about 15 gallons of liquid binder material per minute, per foot width of the applicator 10, and preferably about 10 gallons of liquid binder material per minute, per foot width of the applicator. This will give the liquid binder at the top 34 of the pipe a depth within the range of from about 0.05 to about 0.5 inches, and typically about 0.15 inches. Too much binder will produce a mat that is too wet, and too little binder will create an unstable film, possibly resulting in areas on the mat without binder. A preferred binder is a urea formaldehyde latex binder having about 10 percent latex, about 20 percent solids, and a viscosity of about 4 centipoise.

The binder applicator of the invention is to be operated under a liquid pressure. This is typically accomplished by a liquid binder pump, not shown, positioned upstream from the inlet conduit 28. The pressures within the binder applicator 10 will vary, depending on the location within the applicator, but the pressure at the binder inlet 28 is typically on the order of about 3 or 4 inches of water pressure. Obviously, by the time the liquid reaches the horizontal reservoir, the pressure is zero.

The liquid binder material flowing over the top 34 of the pipe flows in a path 60 that initially follows a curved surface 62. As shown, this curved surface generally follows the curvature of the pipe 12, although this is not required. The curved surface 62 directs the thin layer of binder material onto a downwardly sloping stiffened sheet metal plate 64 to form the curtain 22 of liquid binder. The plate is substantially vertical, which for purposes of this invention is defined as being at an angle 63 that is anywhere from 0 to about 50 degrees from the vertical. Preferably the plate is oriented at an angle of no more than about 40 degrees from the vertical, and most preferably at an angle of about 30 degrees from the vertical. As the thin layer of binder material flows down the sheet metal plate 64, the liquid accelerates and becomes thinner, typically reducing its depth or thickness from about 0.15 inches at the top 34 of the pipe to about 0.05 inches at the bottom 66 of the sheet metal plate, although the thin flow of binder material could have a thickness as great as 0.3 inches. The sheet metal plate 64 is positioned as close as possible to the nonwoven web 20 to prevent decay or distortion of the freefalling curtain 22. Typically, the bottom 66 of the plate 64 will be about 1 to about 3 inches from the web.

The thin flow of the binder material is in an inherently unstable hydrodynamic condition. The use of a curved surface for the path 60 enables the liquid binder to have a smooth transition, without abrupt direction changes, from the horizontal flow at the top 34 of the pipe 12 to the nearly vertical flow along the plate 64. The gentle curve of the surface 62 reduces the possibility of flow breaks or disruptions that can occur in applicator systems having abrupt direction changes. Also, it is imperative that both the curved outer surface 62 of the pipe and the sheet metal plate 64 be formed with an absolutely smooth surface construction. There should be no joints or attachment fittings in these surfaces, and preferably these surfaces should be formed by rolling a stainless steel sheet. Most preferably, the curved surface 62 and the sheet metal plate are formed from a single piece of stainless steel sheet metal.

Figure 3:
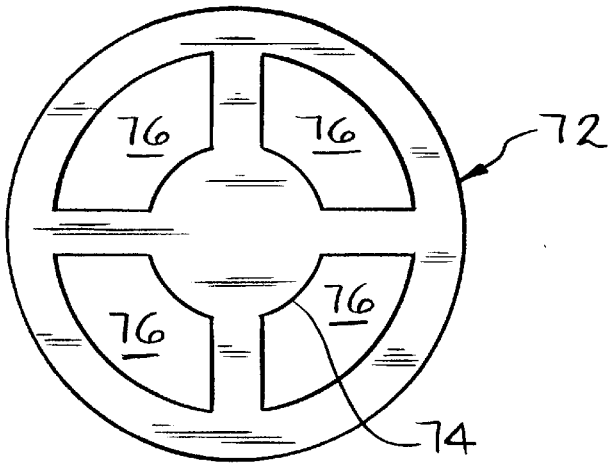
FIG. 3 is a schematic elevational view of the baffle plate in the inlet of the binder applicator shown in FIGS. 1 and 2.

One additional optional feature of the binder applicator of the invention is an inlet chamber 70 positioned between the inlet conduit 28 and the pipe 12. The inlet chamber helps diffuse the flow of binder material flowing into the pipe. A diffuser plate or baffle 72, shown in FIGS. 2 and 3, can be positioned at the inlet end 26 of the pipe to help prevent backflow, spread the liquid and drop the velocity of the liquid so that entrained air and foam can rise to the top of the pipe for removal through the foam exhaust conduit 36. The baffle 72 can be positioned so that the inlet conduit impinges at the center portion 74 of the baffle. The liquid binder is forced to divide and flow through the openings 76 in the baffle plate, and the increase in cross-sectional area of the openings over the cross-sectional area of the inlet conduit necessarily results in a velocity decrease for the binder material.

An additional optional feature of the invention is the use of shims, not shown, in conjunction with the mounting of each end of the pipe, for enabling adjustments in the height of the pipe at each end.

In another embodiment of the invention, the top surface 53 of the liquid binder is purposely disturbed to effect an uneven distribution of the liquid binder making up the thin flow traveling along the path 60. For example, it may be necessary to have a greater amount of binder material at one particular edge of the mat. Any means for effecting an uneven flow of binder can be used, such as, for example, an uneven shape to the sloped outlet surface 55.

Figure 4:
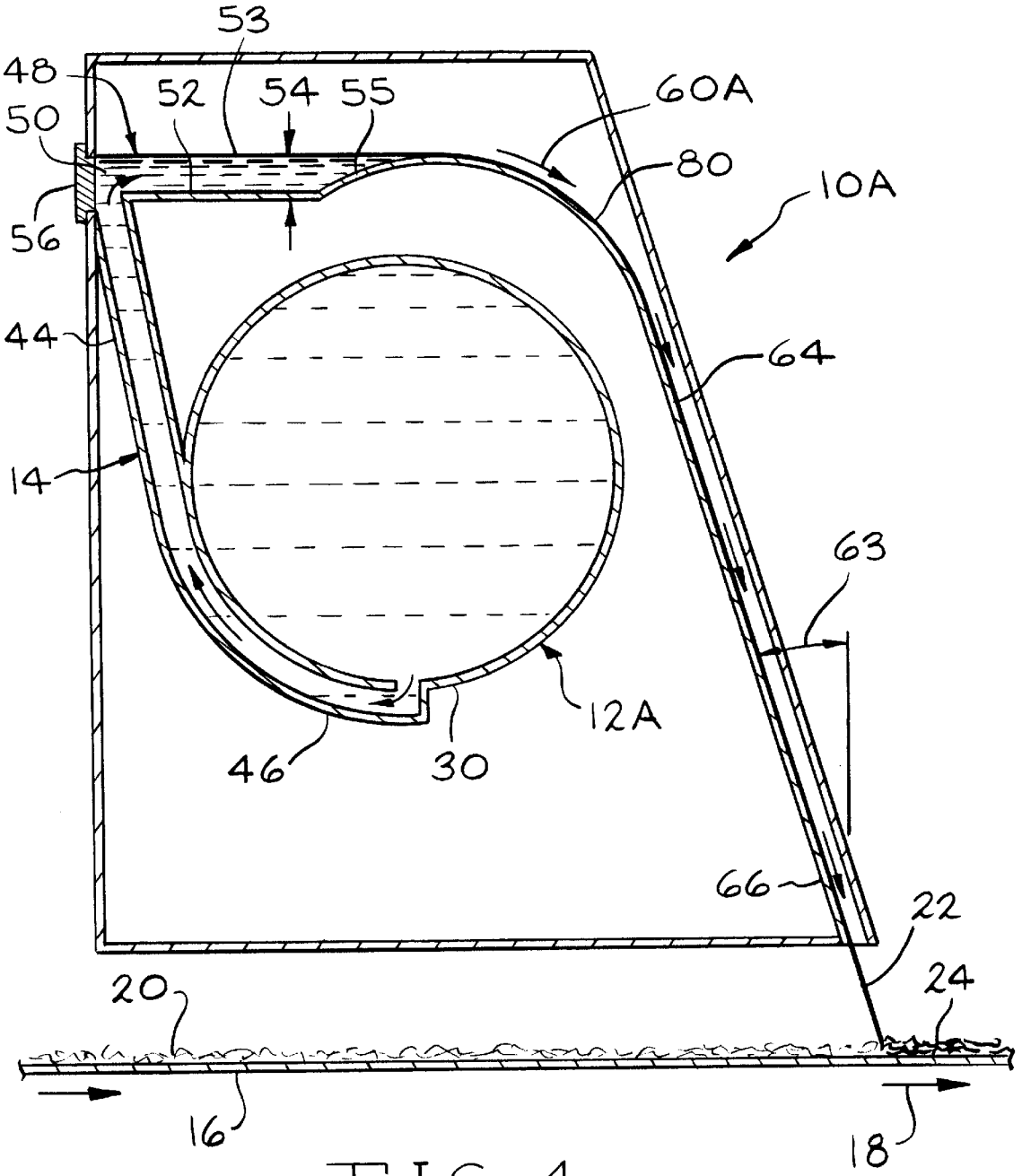
FIG. 4 is a schematic cross-sectional view in elevation of another embodiment of the liquid binder applicator of the invention.

In another embodiment of the invention, as shown in FIG. 4, the flow path 60A of the applicator 10A travels along an independent flow surface 80 that is not part of the pipe 12A. The flow path is separated from the pipe 12A by a substantial distance. Even though the independent flow surface 80 is not coincident with the curved outer surface 62 of the pipe, the independent flow surface still provides for a gradual changing of the flow path to a substantially vertical direction.

The principle and mode of operation of this invention have been described in its preferred embodiments. However, it should be noted that this invention may be practiced otherwise than as specifically illustrated and described without departing from its scope.

What is claimed is:

1. A binder applicator for applying binder to a moving substrate comprising:

a distribution pipe for containing liquid binder, the pipe extending transverse to the direction of movement of the substrate and having a bottom provided with a discharge opening for discharging the liquid binder contained therein;

a distributor channel for receiving liquid binder from the discharge opening and directing the liquid binder upward;

a horizontal reservoir for receiving the liquid binder from the distributor channel;

a weir for metering discharge of the liquid binder from the horizontal reservoir to form a thin horizontal flow of liquid binder; and a curved surface for receiving the thin horizontal flow of binder and gradually changing flow path of the liquid binder from the thin horizontal flow of binder to a substantially vertical thin flow of binder for discharge onto the moving substrate.

2. The binder applicator of claim 1 in which the discharge opening is a plurality of orifices.

3. The binder applicator of claim 1 in which the pipe has a circular cross-sectional shape.

4. The binder applicator of claim 1 including means for disturbing the liquid binder to effect an uneven distribution of the liquid binder discharged from the horizontal reservoir.

5. The binder applicator of claim 1 in which the horizontal reservoir has a sloped outlet surface.

6. The binder applicator of claim 1 in which the curved surface is formed by rolling sheet metal.

7. The binder applicator of claim 1 including an inlet conduit at one end of the pipe for supplying liquid binder to the pipe, an inlet chamber positioned between the inlet conduit and the pipe, and a baffle positioned within the inlet chamber for dividing the liquid binder and slowing the velocity of the liquid binder before the liquid binder reaches the pipe.

8. The binder applicator of claim 7 including a foam exhaust conduit positioned at a distal end of the pipe for removing foamed binder.

9. The binder applicator of claim 1 including a plate along which flows the substantially vertical flow of binder.

10. The binder applicator of claim 9 in which the plate is oriented at an angle of less than about 40 degrees from the vertical.

11. A binder applicator for applying binder to a moving substrate comprising:

a distribution pipe for containing liquid binder, the pipe extending transverse to the direction of movement of the substrate, having a bottom provided with a plurality of discharge orifices for discharging the liquid binder contained therein, and having a top;

a distributor channel for receiving liquid binder from the discharge orifices and directing the liquid binder upward;

a horizontal reservoir for receiving the liquid binder from the distributor channel;

a weir for metering discharge of the liquid binder from the horizontal reservoir to form a thin horizontal flow of liquid binder; and a curved surface for receiving the thin horizontal flow of binder and gradually changing flow path of the liquid binder from the thin horizontal flow of binder to a substantially vertical thin flow of binder for discharge onto the moving substrate.

12. The binder applicator of claim 11 in which the horizontal reservoir has a sloped outlet surface.

13. The binder applicator of claim 11 in which the pipe has a circular cross-sectional shape, and further including an inlet conduit at one end of the pipe for supplying liquid binder to the pipe, an inlet chamber positioned between the inlet conduit and the pipe, a baffle positioned within the inlet chamber for dividing the liquid binder and slowing the velocity of the liquid binder before the liquid binder reaches the pipe, a foam exhaust conduit positioned at a distal end of the pipe for removing foamed binder, and a plate along which flows the substantially vertical flow of binder.

14. The method of applying binder to a substrate comprising:

moving the substrate along a machine direction;

discharging liquid binder from the discharge orifice arranged on bottom of a distribution pipe extending transverse to the direction of movement of the substrate;

receiving the liquid binder from the discharge orifice and directing the liquid binder upward through a distributor channel;

receiving the liquid binder from the distributor channel into a horizontal reservoir;

metering discharge of the liquid binder from the horizontal reservoir with a weir to form a thin horizontal flow of liquid binder;

gradually changing flow path of the liquid binder with a curved surface from the thin horizontal flow of the liquid binder to a substantially vertical thin flow of binder; and discharging the substantially vertical flow of binder onto the moving substrate.

15. The method of claim 14 in which the liquid binder is disturbed to effect an uneven distribution of the liquid binder of the binder discharged from the horizontal reservoir.

16. The method of claim 14 including supplying liquid binder to one end of the pipe with an inlet conduit at one end of the pipe, positioning an inlet chamber between the inlet conduit and the pipe, and positioning a baffle within the inlet chamber for dividing the liquid binder and slowing the velocity of the liquid binder before the liquid binder reaches the pipe.

17. A binder applicator for applying binder to a moving substrate comprising:

a distribution pipe for containing liquid binder extending traverse to the direction of movement of the substrate, the pipe having a bottom provided with a discharge opening for discharging the liquid binder contained therein;

a distributor channel for receiving the liquid binder from the discharge opening and directing the liquid binder upward; and a horizontal reservoir for receiving the liquid binder from the distributor channel; wherein the pipe has a top and the top of the pipe acts as a weir for metering discharge of the liquid binder from the horizontal reservoir to form a thin horizontal flow of the liquid binder and wherein the pipe has a curved outer surface and the curved outer surface provides a curved surface for receiving the thin horizontal flow of binder and gradually changing flow path of the liquid binder from the thin horizontal flow of binder material to a substantially vertical thin flow of binder for discharge onto the moving substrate.

18. The method of applying binder to a substrate comprising:

moving the substrate along a machine direction;

discharging liquid binder from a discharge orifice arranged on bottom of a distribution pipe extending transverse to the direction of movement of the substrate;

receiving the liquid binder from the discharge orifice and directing the liquid binder upward through a distributor channel;

receiving the liquid binder from the distribution channel into a horizontal channel;

metering discharge of the liquid binder from the horizontal reservoir with top of the pipe which acts as a weir to form a thin horizontal flow of liquid binder;

gradually changing flow path of the liquid binder with curved surface of the pipe from a thin horizontal flow of the liquid binder to a substantially vertical thin flow of binder; and discharging the substantially vertical flow of binder onto the moving substrate.

* * * * *

UNITED STATES PATENT AND TRADEMARK OFFICE

CERTIFICATE OF CORRECTION

PATENT NO. : 5,843,531

DATED : December 1, 1998

INVENTOR(S) : Paul A. Klett

It is certified that error appears in the above-indentified patent and that said Letters Patent is hereby corrected as shown below:

Claim 14, lines 50 and 51 should read:

discharging liquid binder from discharge orifice arranged on the bottom of a distribution. . .

Claim 17, line 20 should read:

transverse to the direction of movement of the . . .

Signed and Sealed this

Twenty-sixth Day of October, 1999

*Attest:*

*Attesting Officer*

Q. TODD DICKINSON

*Acting Commissioner of Patents and Trademarks*